US009743781B2

(12) United States Patent
Alshammari

(10) Patent No.: US 9,743,781 B2
(45) Date of Patent: Aug. 29, 2017

(54) MULTI-FUNCTIONAL HOMECARE DEVICE

(71) Applicant: Saud Abdulaziz Alshammari, La Jolla, CA (US)

(72) Inventor: Saud Abdulaziz Alshammari, La Jolla, CA (US)

( * ) Notice: Subject to any disclaimer, the term of this patent is extended or adjusted under 35 U.S.C. 154(b) by 505 days.

(21) Appl. No.: 14/281,112

(22) Filed: May 19, 2014

(65) Prior Publication Data

US 2015/0327691 A1 Nov. 19, 2015

(51) Int. Cl.

| | |
|---|---|
| ***A47F 1/04*** | (2006.01) |
| ***G07F 11/62*** | (2006.01) |
| ***A61J 1/16*** | (2006.01) |
| ***B65D 81/18*** | (2006.01) |

(52) U.S. Cl.

CPC ..... *A47F 1/04* (2013.01); *G07F 11/62* (2013.01); *A61J 1/165* (2013.01); *B65D 81/18* (2013.01)

(58) Field of Classification Search

CPC ..... B65D 81/18; A61J 1/165; A61J 1/00
See application file for complete search history.

(56) References Cited

U.S. PATENT DOCUMENTS 5,646,912 A * 7/1997 Cousin ..... A61J 7/0481 221/15
5,868,135 A * 2/1999 Kaufman ..... G06F 19/3462 600/300
6,360,140 B1 * 3/2002 Vidondo ..... G07F 11/58 221/129
7,326,428 B2 * 2/2008 Weir ..... A47J 47/10 220/23.88
8,550,251 B1 * 10/2013 Ford ..... A61K 38/28 206/370
8,595,025 B2 11/2013 Bailey et al.
2012/0185267 A1 7/2012 Kamen et al.
2013/0030566 A1 * 1/2013 Shavelsky ..... A61J 7/04 700/244
2013/0151274 A1 6/2013 Bage et al.

OTHER PUBLICATIONS

MedSmart PLUS Monitored Automatic Medication Pill Dispenser, www.epill.com; e-pill, LLC; http://www.epill.com/medsmartplus.html (5 pages).

* cited by examiner

*Primary Examiner* — Elaine Gort
*Assistant Examiner* — Evangeline Barr
(74) *Attorney, Agent, or Firm* — Oblon, McClelland, Maier & Neustadt, L.L.P.

(57) ABSTRACT

A multi-function homecare system including a dispensing device having a housing, a display device, a video camera, a speaker, a plurality of compartments, a cover for the plurality of compartments, and a control unit. The control unit of the dispensing device may be operable to issue an alarm and open the cover when a current date and time matches a prescription schedule stored on the control unit. The multi-functional homecare system may further include a controlling device that includes a control unit that is operable to transmit a new prescription schedule to the dispensing device in order to replace a previous prescription schedule.

10 Claims, 8 Drawing Sheets

MULTI-FUNCTIONAL HOMECARE DEVICE

GRANT OF NON-EXCLUSIVE RIGHT

This application was prepared with financial support from the Saudia Arabian Cultural Mission, and in consideration therefore the present inventor(s) has granted The Kingdom of Saudi Arabia a non-exclusive right to practice the present invention.

DESCRIPTION OF THE RELATED ART

The "background" description provided herein is for the purpose of generally presenting the context of the disclosure. Work of the presently named inventor, to the extent it is described in this background section, as well as aspects of the description which may not otherwise qualify as prior art at the time of filing, are neither expressly or impliedly admitted as prior art against the present invention.

Monitoring devices are generally limited to monitoring a patient's vital statistics and sending the information to the patent's primary care provider, such as a physician. The monitoring devices may also monitor whether the correct type and quantity of drugs or fluids are present in the respective drug or fluid dispensers. However, these monitoring devices lack mobility, flexibility, and functionality to meet patient's need for greater independence and ease of use. Additionally, these monitoring devices lack the ability to enable homecare providers and family members to be more involved in the care giving process.

SUMMARY

According to one aspect of the present disclosure, the multi-functional homecare system may provide patients with greater independence while ensuring that their health and vital signals are properly monitored and that necessary medication is taken when appropriate. The multi-functional homecare system may include a monitoring and dispensing device comprising: a housing, a first plurality of compartments, a cooling system, a display device, a video camera, a power supply and power input port, a rechargeable battery, and a control unit.

In selected embodiments, the housing may further include one or more secondary compartments that are sized larger than the first plurality of compartments. The housing may include one or more protective covers that are fixed over the first plurality of compartments and/or the secondary compartment when the compartments are not being used or accessed. The housing may include a waste compartment, and the waste compartment may include a one-way opening to ensure that biohazardous or medical waste is not improperly disposed of.

In selected embodiments, the control unit may include a processor, memory, input/output ports, USB port(s), a memory card slot, a wired networking adapter, a wireless networking adapter, and/or a cellular network adapter. The cellular network adapter may include a SIM card slot. By including one or more types of networking adapters, or a single networking adapter operable on multiple types of networks, the control unit of the multi-functional homecare system may successfully communicate with and interact with a primary care provider, a homecare provider, and/or a family member, regardless of location. The multiple forms of connectivity allow the multi-functional homecare system to be compatible with numerous types of networks, thereby making it cost-effective and easy to employ since it can operate on existing infrastructure.

In selected embodiments, the display device may include a video camera and one or more speakers. The display device may be pivotally mounted to the housing to adjust input and viewing angles. The display device may be removably mounted to the housing and the housing may include a corresponding dock and locking mechanism for securing the display device to the housing. The display device may be a touch screen display. The housing and/or the display device may include physical buttons for input operations.

In selected embodiments, control unit may include programs, software, code, or instructions stored on non-transitory computer readable storage medium. The multi-functional homecare system may include programs to receive instructions and/or prescriptions from a doctor, pharmacist, and/or other medical professionals. The multi-functional homecare system may, based on the received instructions and/or prescriptions, to open/close appropriate compartments in the housing to dispense the proper dosage of medication at appropriate times.

In selected embodiments, the multi-functional homecare system may send alerts and reminders to the patient when it is an appropriate time to take medication. The multi-functional homecare system may monitor the patient while they take medication to ensure compliance, and/or to ensure that the medication is taken properly. The monitoring may be recorded and saved to the memory of the control unit. The monitoring may be transferred and sent externally from the multi-functional homecare system to a receiving system of a primary care provider, a homecare provider, and/or a family member. The monitoring may include saving a record of the monitoring in the event the patient has not properly taking his/her medication, detect potential drug abuse by the patient, and/or tampering by a third party. The monitoring may also enable the primary care provider, the homecare provider, and/or the family member to interact with the patient to ensure greater compliance or provide specialized instructions, as needed.

In selected embodiments, the multi-functional homecare system may receive health and vital signals from the patient. The multi-functional homecare system may obtain health and vital signals via sensor or sensors worn by the patient. The sensor or sensors may be connected to the multi-functional homecare system via wired and/or wireless connections. The multi-functional homecare system may record and save the health and vital signals to the memory of the control unit. The multi-functional homecare system may transfer and send the health and vital signals to a receiving system of one or more of a primary care provider, a homecare provider, and/or a family member. By saving and/or sending the health and vital signals, a digital medical record of the patient may be seamlessly created. Moreover, any sensed abnormalities of health and vital signals may quickly be identified and the appropriate parties may be alerted, thereby improving response times in the event of an emergency.

In selected embodiments, the multi-functional homecare system may allow the patient to connect with and speak to a primary care provider, a homecare provider, and/or a family member. The multi-functional homecare system may establish an audio and/or video connection with one or more of the primary care provider, the homecare provider, and/or the family member who may be located at a remote location from the patient. An audio and/or video connection may be initiated by any of the parties, or may be initiated based on a predetermined appointment. The audio and/or video connection may be initiated based on a predetermined condition such as abnormal health and vital signals received from the patient or if the patient fails to timely take their medication. The audio and/or video connection may be initiated based on a failure of the multi-functional homecare system. The audio and/or video connection may be initiated based on low or depleted supply levels of one or more medications stored by the multi-functional homecare system. By providing an audio and/or video connection capability, a patient may be able to interact and consult with the primary care provider, the homecare provider, and/or the family member from the comfort of their home, thereby enabling the patient to be more independent and providing them with a greater sense of security.

In selected embodiments, the multi-functional homecare system may receive messages, alerts, and/or news from a primary care provider, a homecare provider, and/or a family member, and display them to the patient via a display device. The multi-functional homecare system may read aloud received messages, alerts, and/or news via one or more speakers. The multi-functional homecare system may send messages and/or alerts to the primary care provider, the homecare provider, the family member, and/or an emergency response services (e.g., ambulance, police, etc.).

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings.

The above embodiments and modifications will be described in detail below. It should be understood, however, that there is no intention to limit the present disclosure to the specific forms disclosed, but on the contrary, the intention is to cover all modifications, alternative constructions, and equivalents falling within the spirit and scope of the present disclosure as defined by the appended claims.

DETAILED DESCRIPTION OF THE EMBODIMENTS

Objects, advantages, and features of the exemplary multi-functional homecare system described herein will be apparent to one skilled in the art from a consideration of this specification, including the attached drawings.

Figure 1:
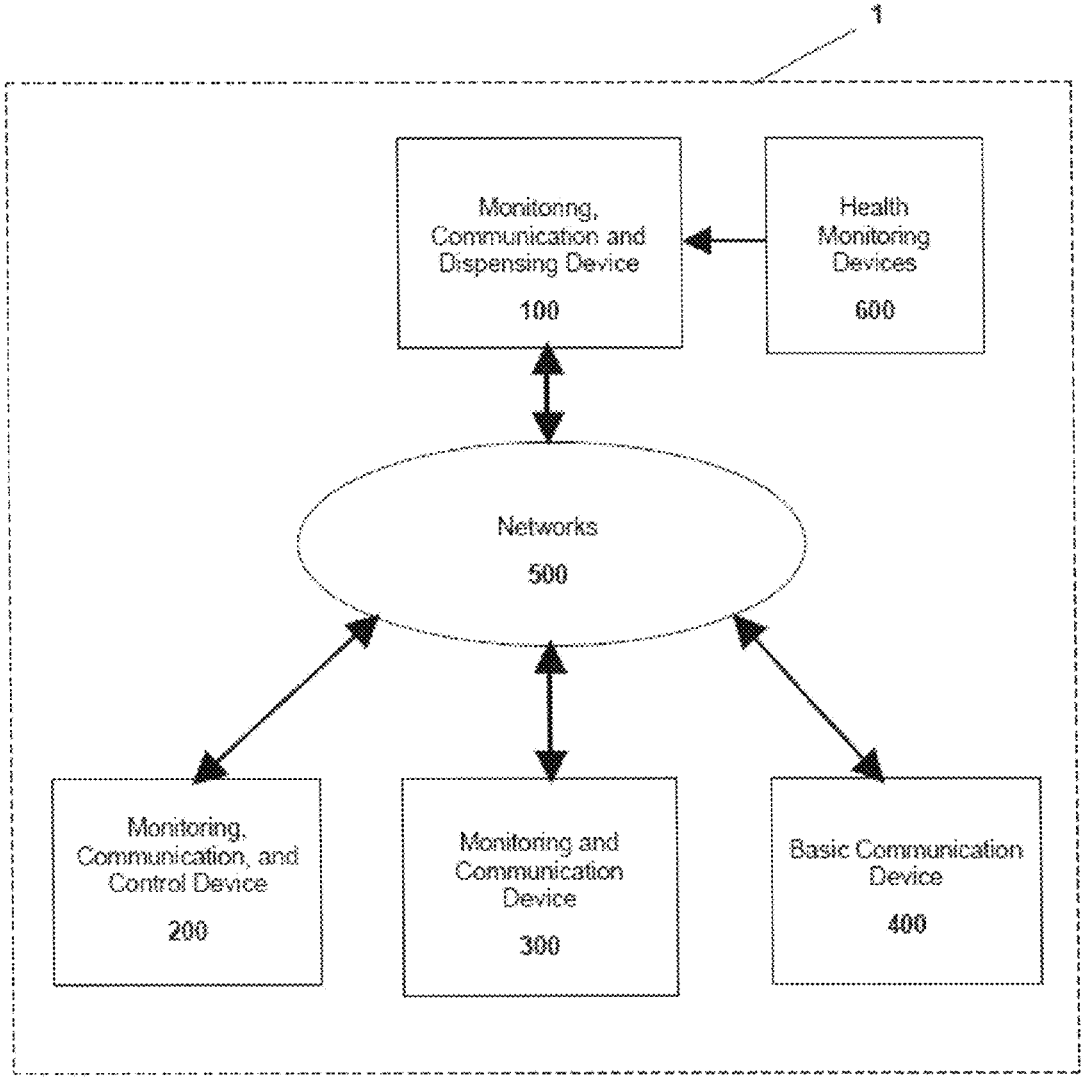
FIG. 1 depicts an exemplary diagrammatic view of a multi-functional homecare system according to one example.

According to one embodiment as shown in FIG. 1, a multi-functional homecare system 1 may comprise a dispensing or MCD Device 100 and one or more of a controlling or MCC Device, a MC Device 300, and a BC Device 400. The MCD Device 100, the MCC Device 200, the MC Device 300, and/or the BC Device 400 may be interconnected through one or more networks 500 to transmit and receive data.

In selected embodiments, the networks 500 may include wired or wireless connections. The wired connections may include, but are not limited to, cables or other transmission lines operable to transmit analog, digital, and/or optical signals. The wireless connection may include, but are not limited to, transmitters/receivers to transmit and to receive radio, cellular, infrared, satellite, and/or microwave signals. The networks 500 may, via appropriate servers and routers, interconnect disparate types of wired and/or wireless connections such that a MCD Device 100 connected to a first type of networking connection may still interact with a MCC Device 200 connect to a second type of networking connection. For example, the MCD Device 100 may be connected via a cellular network using a SIM card, while the MCC Device 200 may be connected to a wireless internet network through an internet service provider.

With regards to the MCD Device 100 and the MCC Device 200, in selected embodiments, the MCD Device 100 may be provided to and operated by a patient and the MCC Device 200 may be provided to and operated by a primary care provider, such as a doctor, nurse, or pharmacist. The MCD Device 100, as will be described in more detail below, may include a monitoring unit to receive health and vital signals from one or more health monitoring devices 600 that may be used or worn by the patient. The health and vital signals may be transmitted from the MCD Device 100 to the MCC Device 200, via the networks 500, for observation, review, and/or recordation purposes by the primary care provider.

In selected embodiments, the MCC Device 200 may include networking componentry to connect to the networks 500. The MCC Device 200 may include a display portion, an input portion, a video camera, and/or one or more speakers. The MCC Device 200 may include circuitry to transmit instructions, commands, messages and/or news to a MCD Device 100. The MCC Device 200 may include circuitry to transmit and receive audio and visual data to and from one or more of a MCD Device 100, MC Device 300, and BC Device 400.

In selected embodiments, the one or more health monitoring devices 600 may be worn by the patient or temporarily activated to perform a particular test. The one or more health monitoring devices 600 may measure health and vital signals of a patient, which may include body temperature, blood pressure, and other bodily indicators relevant to diabetes and other diseases. The MCD Device 100 may in real-time receive health and vital signals obtained by the health monitoring devices 600 and transmit them to the MCC Device 200, via the networks 500, for observation, review, and/or recordation by the primary care provider. In selected embodiments, transmission of data from the health monitoring devices 600 to the MCD Device 100 may be performed via local wired or wireless networks. For example, the local wired or wireless networks may include infrared signals, a shared WiFi connection, and/or a Bluetooth connection.

The MCD Device 100 may include a medication dispensing unit to dispense medication based on a prescription schedule saved on the MCD Device 100. The prescription schedule may be manually programmed onto the MCD Device 100 by an authorized user, such as the primary care provider in the presence of the MCD Device 100. The MCD Device 100 may be set up to require a security password to prevent unauthorized user from tampering with the saved prescription schedule. The prescription schedule may be transmitted from the MCC Device 200 to the MCD Device 100 via the networks 500.

The prescription schedule may include medication dosage information, prescribed time a medication dosage is to be taken, and/or special instructions on how a particular medication is to be taken or administered. The prescription schedule may issue alarms or alerts to the patient, via the MCD Device 100, and/or to the primary care provider, via the MCC Device 200, in the event the prescribed dosage is missed or if there is an error by the MCD Device 100 in dispensing the appropriate medication dosage.

The MCC Device 200 may be operable to transmit a new prescription schedule to the MCD Device 100 to replace a previously saved prescription schedule (the then most recent prescription schedule) on the MCD Device 100. The primary care provider may adjust a frequency or dosage of a medication stored by the MCD Device 100 based on a review of the health and vital signals that the primary care provider received by the MCC Device 200, and/or based on missed dosage of prescribed medication. The MCC Device 200 may be operable to transmit a command to dispense a specified dosage of medication on-demand while the primary care provider, who is using the MCC Device 200, is interacting with the patient, who is using the MCD Device 100 at a different location. In doing so, the primary care provider may be able to make adjustments to the dosage without the primary care provider having to visit the patient, or vice versa.

In selected embodiments, both the MCD Device 100 and the MCC Device 200 may be operable to initiate an audio and/or video connection with the other device to make a voice or video call. The initiation may be made based on a manual request by the patient or the primary care provider, based on a prescheduled appointment, and/or if any health and vital signals received by the MCD Device 100 and/or MCC Device 200 exceed a predetermined threshold.

Turning to the MC Device 300 and the BC Device 400, the MC Device 300 and the BC Device 400 may include the same hardware componentry as the MCC Device 200 but with certain functions disabled or limited via hardware and/or software controls. The MC Device 300 and the BC Device 400 may each include componentry to connect to the networks 500, and may each include a display portion, an input portion, a video camera, and/or one or more speakers. The MC Device 300 and the BC Device 400 may include circuitry to transmit messages and/or news to a MCD Device 100. The MC Device 300 and the BC Device 400 may include circuitry to transmit and receive audio and visual data to and from other MCD Devices 100, MCC Devices 200, MC Devices 300, and/or BC Devices 400.

The MC Device 300 may be limited to receiving and viewing health and vital signals of a patient obtained through the MCD Device 100 and/or initiating/receiving audio and/or video connection with one or more of the MCD Device 100, MCC Device 200, and BC Device 400. For example, the MC Device 300 may be operable by a homecare provider or a family member to initiating/receiving audio and/or video connection with the MCD Device 100. The MC Device 300 may send an alert or message, based on a review of the health and vital signals by the homecare provider or the family member, to the MCD Device 100 to send a reminder of a missed or delayed medication dosage, to send useful information relevant to the patient's care giving needs, and/or to send a personalized message. The MC Device 300 may receive notifications from the MCD Device 100 regarding whether the patient has been timely in taking their medication based on the prescription schedule. However, the MC Device 300 may be disabled from altering the prescription schedule saved on the MCD Device 100, and/or issuing commands to dispense a specified dosage of medication on-demand to the MCD Device 100.

The BC Device 400 may be limited to initiating/receiving audio and/or video connection with one or more of the MCD Device 100, MCC Device 200, and MC Device 400. The BC Device 400 may be used by friends or family members of the patient to keep in touch and interact with the patient. The BC Device 400 may be used by emergency response services to receive distress calls. The MCD Device 100 may include a button or a sensor to automatically connect to a BC Device 400 of an emergency response service, such as emergency medical technicians, paramedics, firefighters, police, etc. If the MCD Device 100 detects that the patient is unable to verbally respond to the emergency response service, the MCD Device 100 may transmit to the BC Device 400 identifying information regarding the patient, current location information of the MCD Device 100, and/or relevant health and vital signals of the patient.

Figure 2:
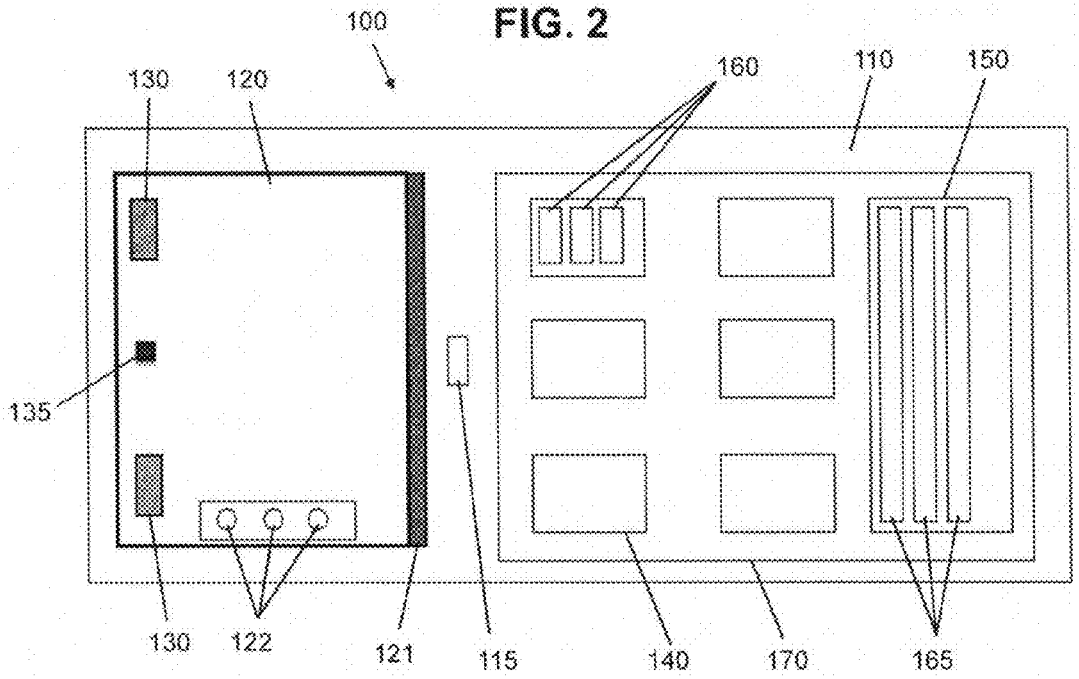
FIG. 2 depicts an exemplary top view of a monitoring, communication, and dispensing device (hereinafter "MCD Device" or "dispensing device") according to one example.
Figure 3:
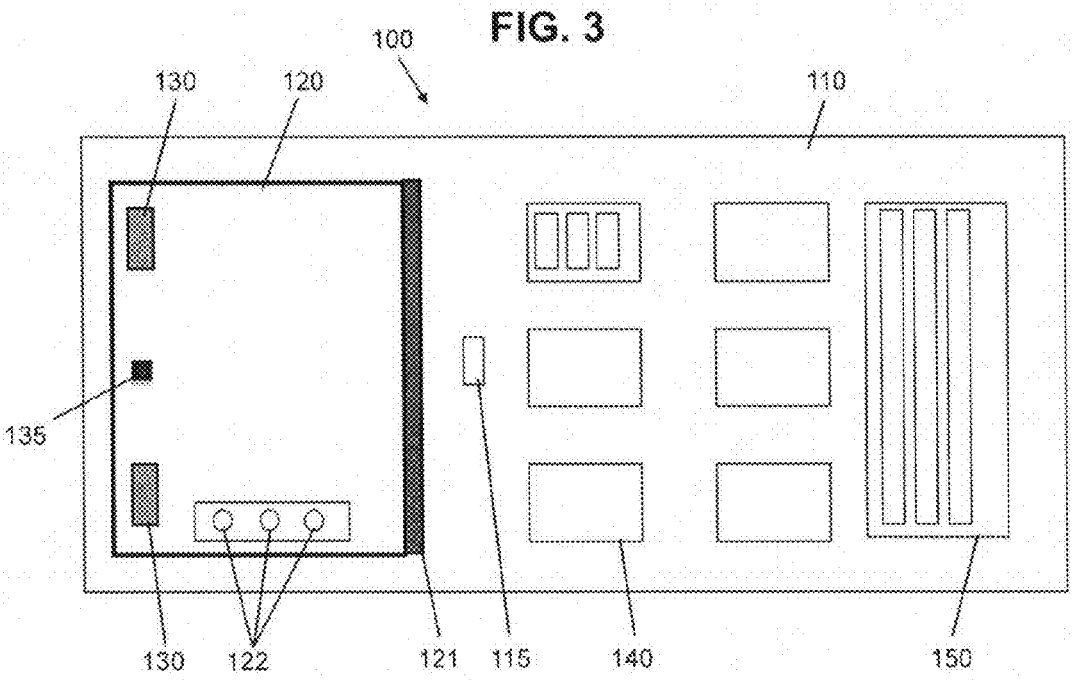
FIG. 3 depicts an exemplary top view of a MCD Device according to one example.

Referring to FIGS. 2 and 3, the MCD Device 100 will now be discussed in greater detail. In one embodiment, the MCD Device 100 may include a housing 110 comprising a display device 120, one or more speakers 130, a video camera 135, and a plurality of compartments 140. The MCD Device 100 may further comprise one or more secondary compartments 150. The plurality of compartments 140 may be used to store medication. The medication may be in the form of a pill, capsule, vial, syringe, etc. The housing 110 may be made of a high-density polypropylene material.

In selected embodiments, the display device 120 may be mounted to the housing 110 via a hinge 121 to enable the display device 120 to be adjusted and set at different viewing angles. The hinge 121 may include a dock connector to enable the display device 120 to be detachably removed from the housing 110. The display device 120 may be a touch screen display. The display device 120 may include one or more physical buttons 122 for input. The display device 120 may have a diagonal screen size of up to 14-inches. The MCD Device 100 may include circuitry and transmitters to control other devices using the touch screen of the display device 120 and/or the physical buttons 122. The MCD Device 100 may be operable to control a television, a radio, room lights, and/or air conditioning of a home.

In selected embodiments, the MCD Device 100 may include at least three physical buttons 122. The buttons 122 may be provided on the display device 120. A first button of the buttons 122 may be programmed to initiate a measurement process in order obtain health and vital signals of the patient. The MCD Device 100 may connect with one or more health monitoring devices 600. The one or more health monitoring devices 600 measures body temperature, blood pressure, and other bodily indicators relevant to diabetes and other diseases. The health and vital signals may be automatically transmitted to a primary care provider after the measurements are conducted.

In selected embodiments, a second button of the buttons 122 may be programmed to initiate a call with a primary care provider via the display device 120 and the video camera 135. In selected embodiments, a third button of the buttons 122 may be programed as a back, cancellation, or exit function button.

In selected embodiments, the plurality of compartments 140 and/or the one or more secondary compartments 150 may store medication directly within their respective compartments. One or more bottles, packets, cartridges, and/or containers 160 including the same or different types of medication may be stored within each of the plurality of compartments 140 and/or secondary compartment 150. The one or more secondary compartments 150 are sized larger than the plurality of compartments 140. The plurality of compartments 140 may be sized between 250 cubic millimeters to 750 cubic millimeters.

In selected embodiments, larger containers or syringes 165 containing a dosage of medication may be stored in the one or more secondary compartments 150. The one or more secondary compartments 150 may be sized 750 cubic millimeters or greater. The MCD Device 100 may include a number of compartments 140, 150 corresponding to a number of separate medication required by the patient. For example, the number of compartments may be between 1 and 10. The MCD Device 100 may include a number of compartments 140, 150 corresponding to a number of days within a calendar week. For example the number of compartments 140, 150 may be between 1 and 7.

In selected embodiments, the MCD Device 100 may include a removable tray 170 carrying the plurality of compartments 140 and/or one or more secondary compartments 150. The removable tray 170 may be inserted into a cutout in the MCD Device 100 for docking. The removable tray 170 may be securely locked to the MCD Device 100. A removable tray 170 depleted of medication may be quickly swapped with a second removable tray 170 that includes new medication for the appropriate patient.

In selected embodiments, the MCD Device 100 may include a detector 115 to determine if a container 160 has been removed from any of the plurality of compartments 140. The detector 115 may be a scanner to scan one or more containers 160 including medication from the plurality of compartments 140 and/or the secondary compartments 150. The detector 115 may be an optical scanner to scan an associated label or code of the containers 160. Alternatively, or in addition to, the detector 115 may be an RFID reader or other reader to sense the presence or absence of the one or more containers 160. Alternatively, or in addition to, the detector 115 may include a weight sensor having a memory indicating a predetermined weight of the one or more containers 160 without anything in them. The detector 115 may then detect and store in memory the additional weight added by medication with the one or more containers. Further, if a particular prescription is known and the dosage, the detector 115 may compute an estimated additional weight amount based on the known dosage amount. In selected embodiments, removal of a container 160 may be indicative that a patient has retrieved and taken a dosage of medication stored within that particular container 160. The detector 115 may automatically scan a container or containers 160 as they are being removed. The detector 115 may also determine based on the weight whether some or all of the prescription has been taken. However, if the detector 115 of the MCD Device 100 does not detect removal of a container 160 corresponding to a prescription schedule, within a predetermined time-out period, the MCD Device 100 may determine that the medication has not been taken and may issue an alarm and/or an alert.

Figure 4:
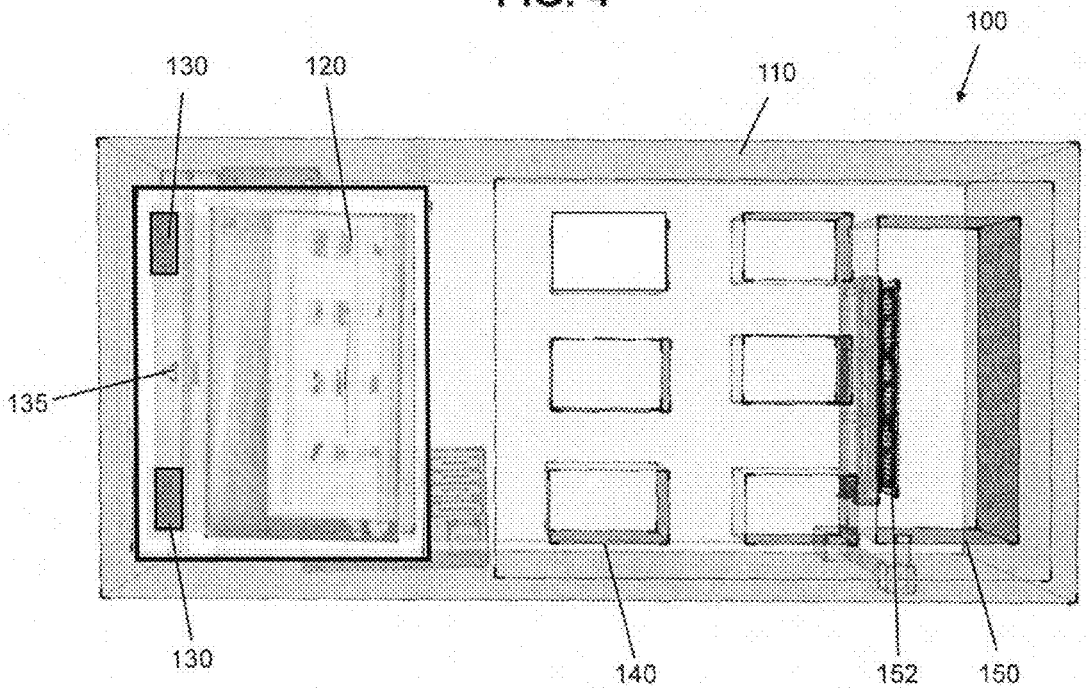
FIG. 4 depicts a perspective top view of the MCD Device according to FIG. 3.
Figure 5:
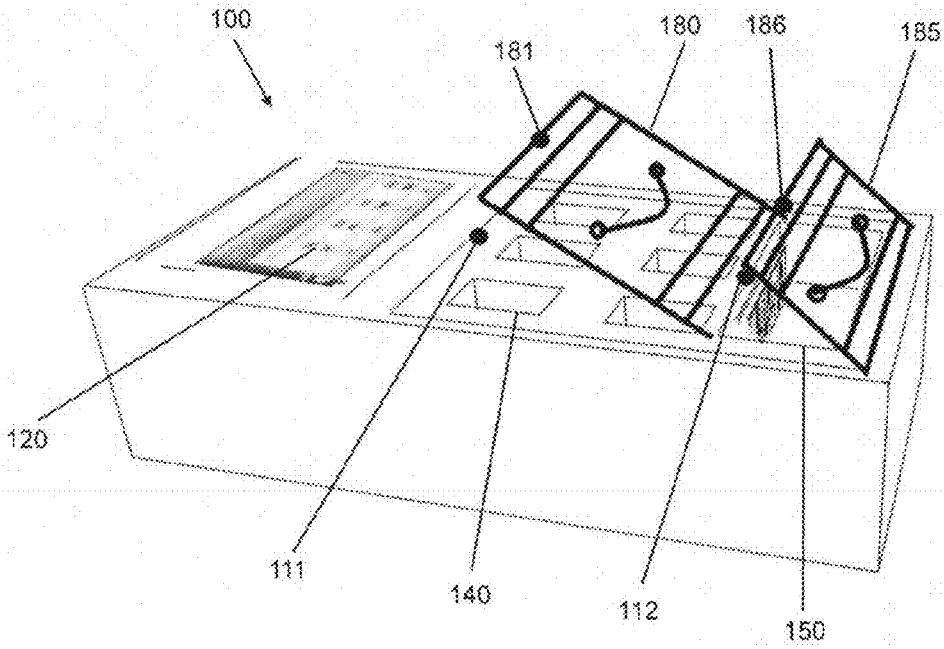
FIG. 5 depicts a perspective side view of the MCD Device according to FIG. 3, including protective covers in an open position according to one example.
Figure 6:
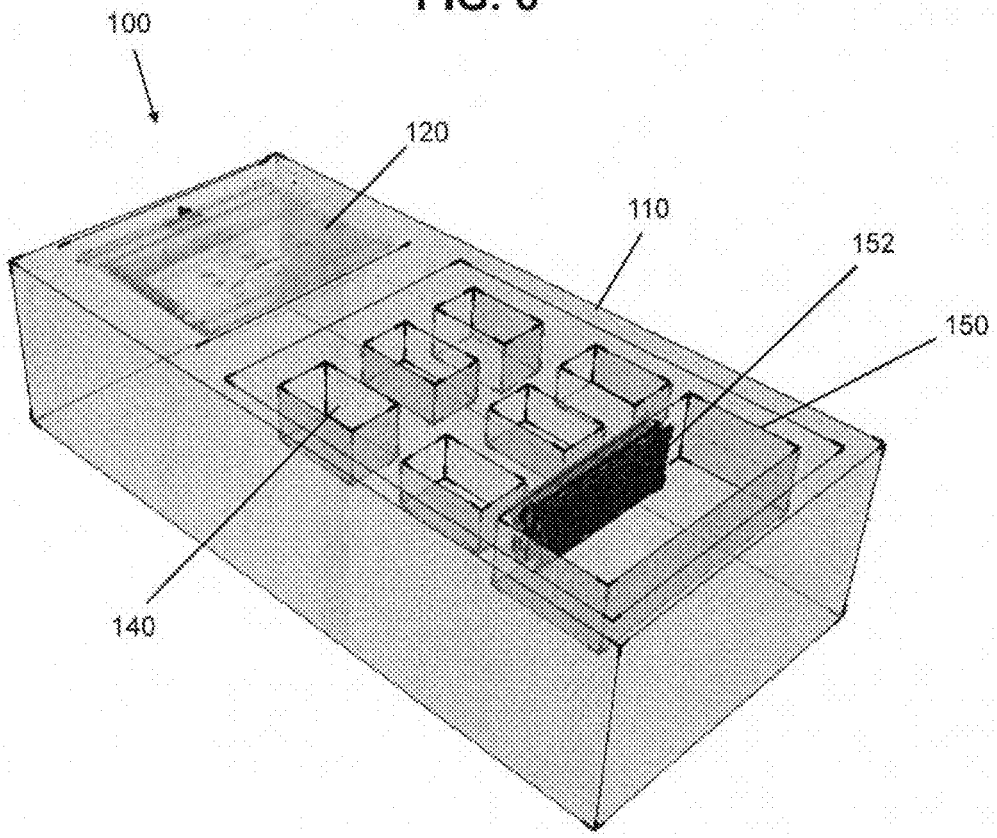
FIG. 6 depicts a second perspective side view, with the housing illustrated in translucent form, to illustrate details of the MCD Device according to FIG. 3.
Figure 7:
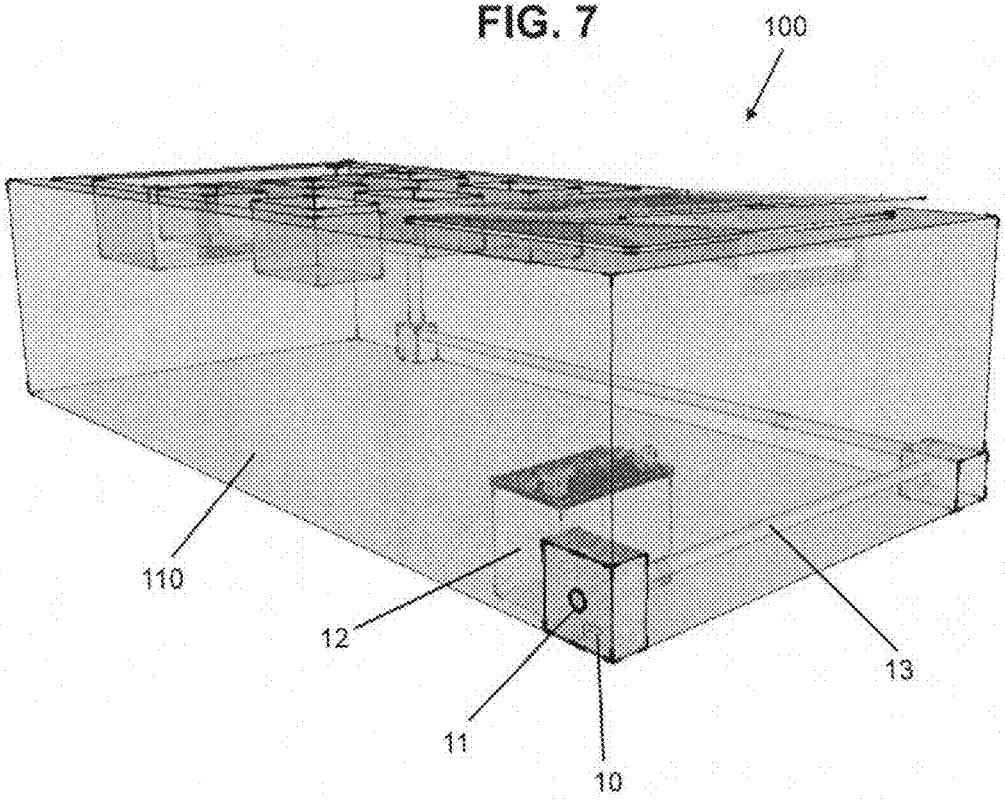
FIG. 7 depicts a third perspective side view, with the housing illustrated in translucent form, to illustrate details of a battery and a power supply of the MCD Device according to FIG. 3.
Figure 8:
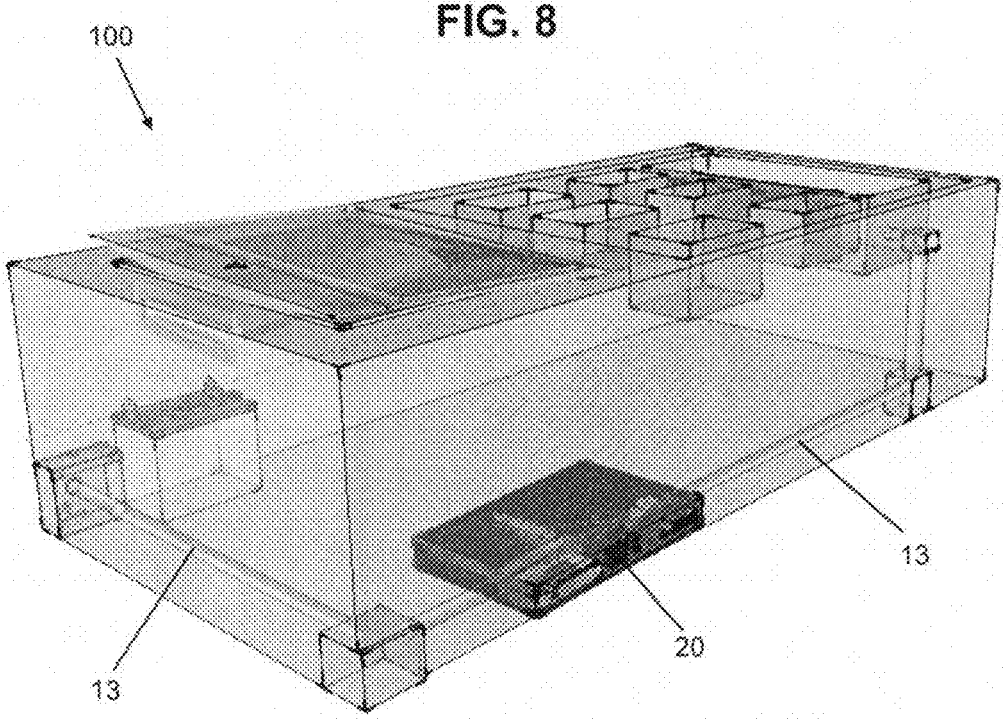
FIG. 8 depicts a fourth perspective side view, with the housing illustrated in translucent form, to show details of a control unit of the MCD Device according to FIG. 3.

In one embodiment, as shown in FIGS. 4-6, the MCD Device 100 may include a cooling system 152 to maintain a regulated temperature in one or more of the plurality of compartments 140 and/or the secondary compartments 150. The cooling system 152 may be disposed on a side wall of the secondary compartment 150 to circulate cooling air within the secondary compartment 150. The cooling system 152 may be particularly useful when a particular medication needs to be maintained within a certain temperature range or if the medication requires refrigeration. The medication may be insulin that needs to be maintained at a cool temperature. The insulin may be stored within a syringe 162 and the secondary compartment 150 may be sized to hold one or more syringes 165. The cooling system 152 may maintain a temperature within the secondary compartment 150 between 30° F. to 90° F. The cooling system 152 may maintain a temperature within the secondary compartment 150 between 30° F. to 50° F.

In one embodiment, as shown in FIG. 5, the MCD Device 100 may include one or more protective covers 180, 185. A protective cover 180 may be provided over the plurality of compartments 140. A protective cover 185 may be provided over the secondary compartment 150. Each of the plurality of compartments 140 may each individually be provided with a separate cover. The protective covers 180, 185 may be hingely attached to the MCD Device 100 at a location adjacent to an opening of the compartments 140, 150. An end of the protective covers 180, 185, opposite the hingely attached end, may include a locking latch 181, 186 to lock the covers 180, 185 to the MCD Device 100. The MCD Device 100 may include a corresponding locking mechanism 111, 112 to selectively lock the covers 180, 185 to the housing 110.

In selected embodiments, the MCD Device 100 may include a power supply 10 with a power input port 11, a rechargeable battery 12, and a plurality of power and signal transmission cables 13. The MCD Device 100 may comprise a control unit 20, a processor, RAM memory, ROM memory, a memory card slot, USB port(s), and/or input/output ports. The control unit 20 may receive power from, via the power supply 10, the rechargeable battery 12 and/or an external power source connected to the power input port 11. The rechargeable battery 12 is a 12-volt battery.

In selected embodiments, the control unit 20 may be connected to the display device 120, the one or more speakers 130, the cooling system 152, the locking latches 181, 186, and/or the video camera 135. The control unit 20 may include circuitry to activate or deactivate the cooling system 152 based on a sensed temperature received by the cooling system 152. Temperature sensors may be provided in or near the first plurality of compartments 140 and/or the secondary compartment 150 to detect a temperature of one or more of the compartments.

In selected embodiments, the control unit 20 may include circuitry to activate or deactivate the locking latches 181, 186 in order to lock protective covers 180, 185 to the housing 110.

In selected embodiments, the control unit 20 may include circuitry to process audio and/or video call data. A microphone may be provided to record sounds directed towards the MCD Device 100 and to play sounds through the speakers 130 received by the MCD Device 100. The video camera 135 may capture still and/or live images and the control unit 20 may process the video image data so that it may be saved on to the MCD Device 100 or transmitted to other devices. The control unit 20 may include circuitry to process incoming image data and to display the processed image data on the display device 120.

In selected embodiments, the MCC Device 200, the MC Device 300, and/or the BC Device 400 may include a control unit 20 with the same functionality as the MCD Device 100. The MCC Device 200, the MC Device 300, and/or the BC Device 400 may each include a display device, a video camera, and one or more speakers. The MCC Device 200, the MC Device 300, and/or the BC Device 400 may include a control unit 20 which may include the same features as the control unit 20 of the MCD Device 100. The circuitry of the control unit 20 of the MCC Device 200, the MC Device 300, and/or the BC Device 400 may be modified or programmed such that cooling system and locking latch functions are disabled or made inoperative.

Figure 9:
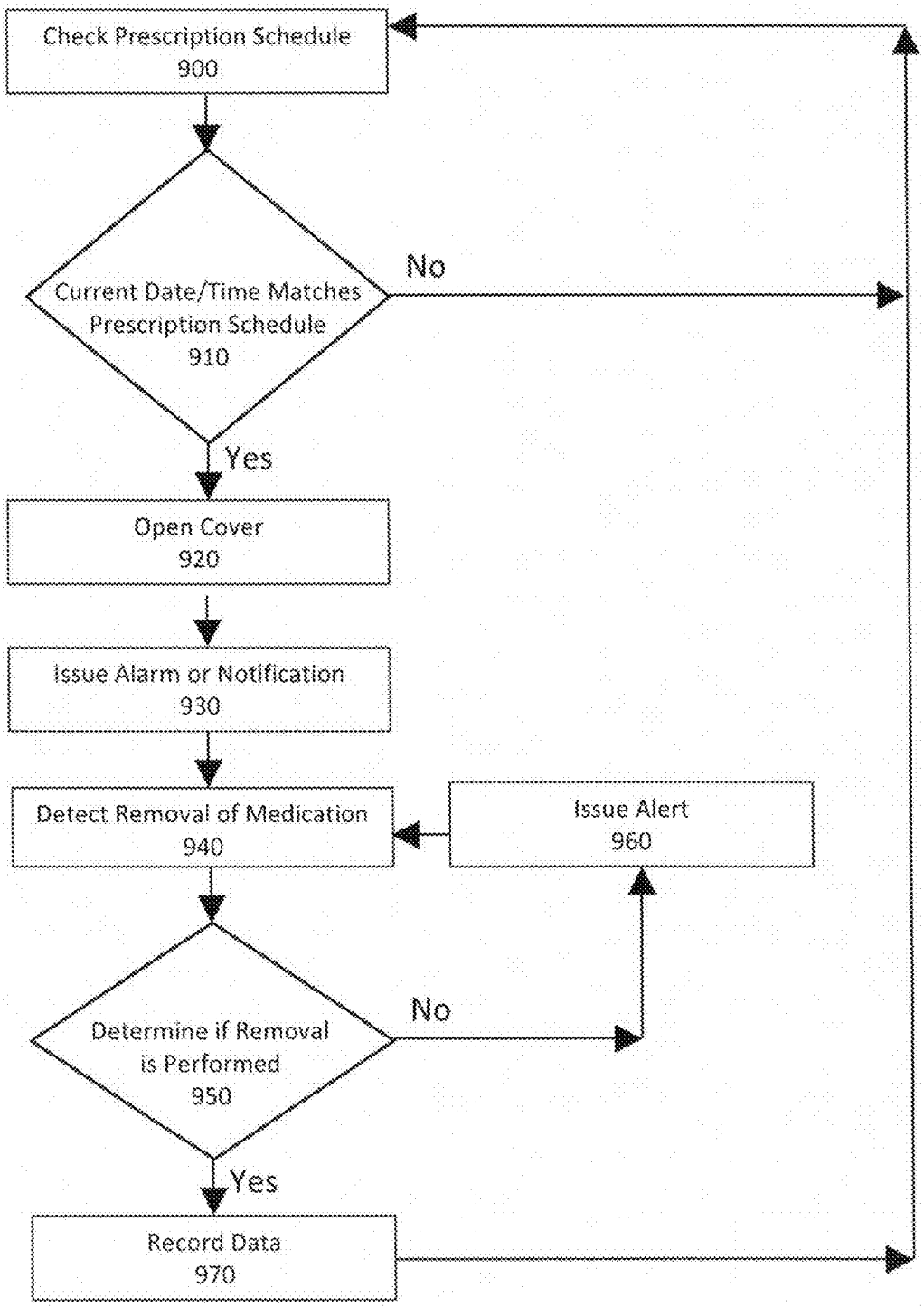
FIG. 9 depicts an exemplary medication dispensing and alert process of the MCD Device according to on example.

Turning to the interaction between the MCD Device 100, the MCC Device 200, the MC Device 300, and/or the BC Device 400 as it relates to monitoring and dispensing medication, FIG. 9 depicts an exemplary medication dispensing and alert process. In step 900, the control unit 20 of the MCD Device 100 may check a prescription schedule (the most recent prescription schedule) saved on the MCD Device 100. In step 910, the MCD Device 100 may check a current date and time against the prescription schedule. If the current date and time matches a date and time stored on the prescription schedule, the MCD Device 100 may proceed to step 920, and if not the MCD Device 100 may return back to step 900.

In step 920, the MCD Device 100 may read medication dosage information associated with a particular date and time stored on the prescription schedule. The MCD Device 100 may then open the appropriate one or more protective covers 180, 185 to enable access to the medication stored in the first plurality of compartments 140 and/or the secondary compartment 150.

In step 930, the MCD Device 100 may provide an alarm to the patient in the form of an audio and/or visual alert. The audio alert may be produced via the one or more speakers 130. The audio alert may be in the form of a tone or chime, or a series of tones and/or chimes. The audio alert may be in the form of spoken text to notify the patient that it is time to take medication. A visual alert may be displayed on the display device 120. The visual alert may include a textual message to notify the patient that it is time to take medication. The visual alert may include an illustration or photo of the specific medication that needs to be taken at the present time. The visual alert may include textual, animated, or video instructions on appropriate steps for taking the medication and/or warnings associated with the specific medication.

In step 940, the MCD Device 100 may sense or detect whether one or more bottles, packets, cartridges, and/or containers 160, corresponding to a dosage of medication for the date and time stored on the prescription schedule, has been removed by the patient. The detector 115 of the MCD Device 100 may include a scanner adjacent to the plurality of compartments 140 and/or the one or more secondary compartments 150. In selected embodiments, the detector 115 may automatically scan containers 160 of medication as they are being removed from the plurality of compartments 140 and/or the one or more secondary compartments 150. The detector 115 may be an optical sensor, bar code reader, an RFID detector, or any other wireless sensor that can detect removal of one or more containers 160 of medication. For example, the detector may be placed at or near an opening or openings of the plurality of compartments 140 and/or the one or more secondary compartments 150 to scan labels including identifying information or a bar code of the containers 160 of medication that may be removed and passed by the detector 115.

Additionally or alternatively, a patient may personally scan a label of a container 160 using a detector 115 located remote from the opening or openings of the plurality of compartments 140 and/or the one or more secondary compartments 150 to indicate that the container 160 has been removed. The removal of a container 160 of medication may provide indication to the MCD Device 100 that the patient is taking their medication at an appropriate time prescribed by the prescription schedule. The MCD Device 100 may activate the video camera 135 to record whether the patient is actually taking their medication. The MCD Device 100 may initiate an audio/video call with a MCC Device 200 and/or a MC Device 300 in order to allow a primary care provider, a homecare provider, and/or a family member to check in or monitor the patient as they are taking their medication.

In step 950, the MCD Device 100 determines whether the patient has removed and taken one or more containers 160 corresponding to a dosage of medication for the date and time stored on the prescription schedule. If the MCD Device 100 determines that the medication has been removed, the process may proceed to step 970.

If the medication has not been removed, the process may proceed to step 960 the MCD Device 100 may issue an alert, after a predetermined time-out period, if the patient has not taken any steps to removed their medication after the initial alarm in step 930. In selected embodiments, a time-out period may be stored on the prescription schedule or the time-out period may be sent from the MCC Device 200. A time-out period may be between 5 seconds to 5 minutes. The time-out period may be 30 seconds. The MCD Device 100 may then return to step 940 to determine whether the patient has removed their medication after the alert in step 960. An alert may be sent to one or more of the MCC Device 200 and a MC Device 300 to notify a primary care provider, a homecare provider, and/or a family member that a dosage of the medication for the date and time stored on the prescription schedule has been missed.

In step 970, once it has been determined that the medication has been removed and taken by the patient, the MCD Device 100 may make a record of the action. The MCD Device 100 may store the record in the memory of the control unit 20. The MCD Device 100 may transmit the record to one or more of the MCC Device 200 and a MC Device 300 to provide confirmation and/or a record that the patient has taken their dosage of the medication for the date and time stored on the prescription schedule. The process may then return to step 900 where the MCD Device 100 may check, monitor, and/or proceed with a next medication dosage stored on the prescription schedule.

Figure 10:
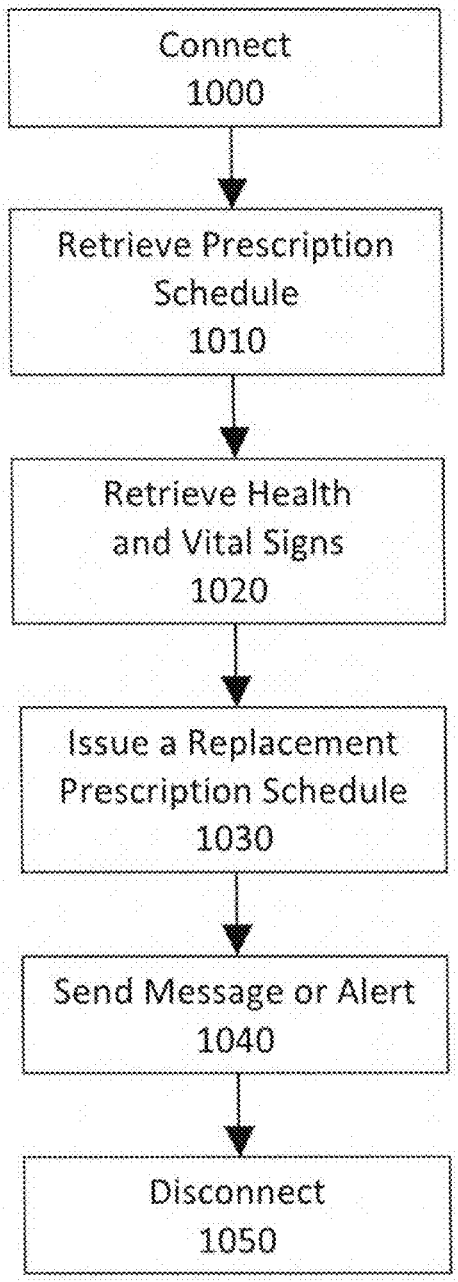
FIG. 10 depicts an exemplary prescription transmission process between a monitoring, communication, and control device (hereinafter "MCC Device" or "controlling device") and a MCD Device according to on example.

Turning to the interaction of a MCC Device 200 and a MCD Device 100 to allow a primary care provider to program or alter a prescription schedule, FIG. 10 depicts an exemplary prescription transmission process. In step 1000, the control unit 20 of a MCC Device 200 may establish a data connection with a MCD Device 100. In selected embodiments, each MCD Device 100 connected to the networks 500 may include a unique identifying serial number and/or may be associated with a unique username. A primary care provider or other authorized personnel may use a MCC Device 200 to initiate a connection with a specific MCD Device 100 based on one or more of the identifying serial number and username.

In step 1010, the MCC Device 200 may query the MCD Device 100 to retrieve a saved prescription schedule on the MCD Device 100. The MCC Device 200 may display contents of the prescription schedule including, but not limited to, the types of medication prescribed, the amount of medication prescribed, and the frequency or schedule in which the medication is to be taken by the patient.

In step 1020, the MCC Device 200 may query the MCD Device 100 to retrieve current and/or past health and vital signals transmitted to and stored on the MCD Device 100. The MCC Device 200 may then display the health and vital signals for the primary care provider to review.

In step 1030, the primary care provider may issue a new or replacement prescription schedule from the MCC Device 200 to the MCD Device 100. The new or replacement prescription schedule may replace the previously saved prescription schedule on the MCD Device 100. In select embodiments, the MCC Device 220 may generate the new or replacement prescription schedule, based on health and vital signals received from the MCD Device 100, and the MCC Device 220 may send the new or replacement prescription schedule to the MCD Device 100. The new or replacement prescription schedule may include a listing of dates and times corresponding to new dates and times that a patient is to take their dosage of the medication. The new or replacement schedule may include a new dosage amount of medication for dates and times previously stored on the then most recent prescription schedule, or include a new dosage amount of medication for new dates and times that a patient is to take their dosage of the medication. The new or replacement prescription schedule may include information regarding medication to be dispensed, information regarding a dosage size of medication, instructions on taking the medication, potential drug interaction warnings, and/or potential side effect warnings.

In step 1040, the primary care provider may send a message, send an alert, and/or initiate an audio and/or video connection from the MCC Device 200 to the MCD Device 100 to discuss changes with the patient or provide additional information to the patient regarding a new medication or a new prescription schedule. In selected embodiments, the protective covers 180, 185 may be locked to the housing 110 to prevent removal of containers 160 of medication from the MCD Device 100 at times other than during the dates and times of the prescription schedule. When a present date and time matches the prescription schedule, the MCD Device 100 may unlock one or more of the locking latches 181, 186 in order to allow the protective covers 180, 185 to be opened and containers 160 to be accessed. The locking latches 181, 186 may be opened at times not corresponding to the prescription schedule by entering an authorization code into the MCD Device 100, or by having the MCC Device 200 send an unlock command to the MCD Device 100. In one non-limiting example, a pharmacist may be able to enter an authorization code in order to open up the protective covers 180, 185 in order to refill a prescription for the MCD Device 100. In one non-limiting example, a doctor may be able to send an unlock command from the MCC Device 200 to the MCD Device 100 to open the protective covers 180, 185 in order for a pharmacist to refill a MCD Device 100, or if a patient using the MCD Device 100 needs to access an additional dosage of a prescription at a time other than one set by the prescription schedule.

In step 1050, the MCC Device 200 may terminate the connection with the specific MCD Device 100.

Figure 11:
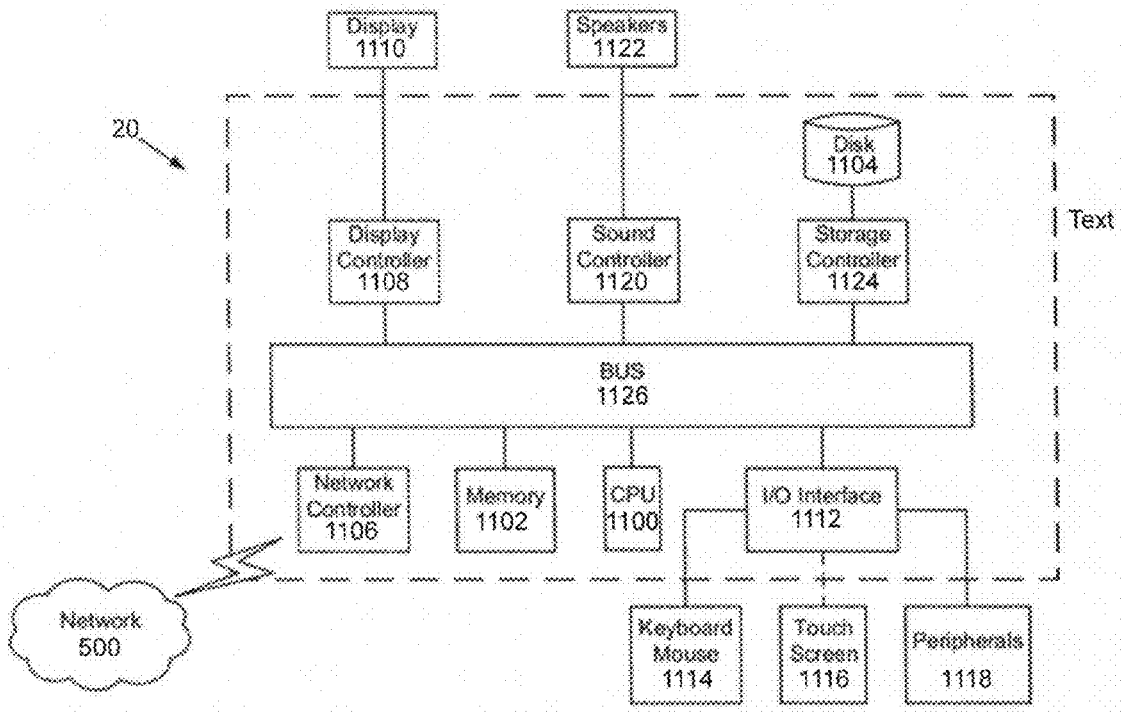
FIG. 11 depicts an exemplary hardware implementation of a control unit of a MCD Device, a MCC Device, a monitoring and communication device (hereinafter "MC Device"), and/or a basic communication device (hereinafter "BC Device") according to on example.

Referring to FIG. 11, a hardware description an exemplary control unit 20 of the MCC Device 100 is described. In FIG. 11, the control unit includes a CPU 1100 which performs the processes described above. The process data and instructions may be stored in memory 1102. These processes and instructions may also be stored on a storage medium disk 1104 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the control unit 20 communicates, such as a server or computer.

Further, the claimed advancements may be provided as a utility application, background daemon, or component of an operating system, or combination thereof, executing in conjunction with CPU 1100 and an operating system such as Microsoft Windows 7, UNIX, Solaris, LINUX, Apple MAC-OS and other systems known to those skilled in the art.

CPU 1100 may be a Xenon or Core processor from Intel of America or an Opteron processor from AMD of America, or may be other processor types that would be recognized by one of ordinary skill in the art. Alternatively, the CPU 1100 may be implemented on an FPGA, ASIC, PLD or using discrete logic circuits, as one of ordinary skill in the art would recognize. Further, CPU 1100 may be implemented as multiple processors cooperatively working in parallel to perform the instructions of the inventive processes described above.

The control unit in FIG. 11 also includes a network controller 1106, such as an Intel Ethernet PRO network interface card from Intel Corporation of America, for interfacing with one or more networks 500. As can be appreciated, the networks 500 can be a public network, such as the Internet, or a private network such as an LAN or WAN network, or any combination thereof and can also include PSTN or ISDN sub-networks. The networks 500 can also be wired, such as an Ethernet network, or can be wireless such as a cellular network including EDGE, 3G and 4G wireless cellular systems. The wireless network can also be WiFi, Bluetooth, or any other wireless form of communication that is known.

The control unit 20 may further include a display controller 1108, such as a NVIDIA GeForce GTX or Quadro graphics adaptor from NVIDIA Corporation of America for interfacing with display 1110, such as a Hewlett Packard HPL2445w LCD monitor. A general purpose I/O interface 1112 interfaces with a keyboard and/or mouse 1114 as well as a touch screen panel 1116 on or separate from display 1110. General purpose I/O interface also connects to a variety of peripherals 1118 including printers and scanners, such as an OfficeJet or DeskJet from Hewlett Packard.

A sound controller 1120 may also provided in the control unit 20, such as Sound Blaster X-Fi Titanium from Creative, to interface with speakers/microphone 1122 thereby providing sounds and/or music.

The general purpose storage controller 1124 connects the storage medium disk 1104 with communication bus 1126, which may be an ISA, EISA, VESA, PCI, or similar, for interconnecting all of the components of the control unit 20. A description of the general features and functionality of the display 1110, keyboard and/or mouse 1114, as well as the display controller 1108, storage controller 1124, network controller 1106, sound controller 1120, and general purpose I/O interface 1112 is omitted herein for brevity as these features are known.

An object of the present disclosure is to provide a multi-functional homecare system to provide greater freedom and independence to patients, particularly elderly and mobility-impaired patients, who seek a greater degree of normalcy in their lives while ensuring their health and vital signals are properly monitored and that necessary medication is taken when appropriate. The multi-functional homecare system of the present disclosure enables homecare providers and family members to be involved in the care giving process, particularly when primary care providers or medical professionals are not required, thereby enabling cost savings and providing a more comfortable and intimate experience for the patients. The multi-functional homecare system of the present disclosure also provides an integrated unit that is full-featured, portable, and easy to deploy in any location.

Because many possible embodiments may be made of the invention without departing from the scope thereof, it is to be understood that all matter herein set forth or shown in the accompanying drawings is to be interpreted as illustrative and not in a limiting sense. Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

What is claimed is:

1. A multi-functional homecare system, the system comprising:

a network; and a dispensing device configured to communicate with a controlling device via the network, the dispensing device including a housing, a tray including a first chamber and a second chamber, the first chamber including a plurality of compartments of a first type, and the second chamber including a plurality of compartments of a second type, each compartment of the first type having a first predetermined volume and adapted to store a first type of medication, and each compartment of the second type having a second predetermined volume and adapted to store a second type of medication, the tray being removably coupled to the dispensing device, and wherein the first predetermined volume is in the range of 250 cubic millimeters to 750 cubic millimeters, and the second predetermined volume is 750 cubic millimeters, a memory that stores a prescription schedule, a display device, a video camera, at least one speaker, a cooler disposed on a sidewall of the second chamber and positioned between the first chamber and the second chamber, and configured to maintain a temperature of the first chamber at a first temperature and maintain the temperature of the second chamber within a second temperature range, a first protective cover adapted to shield the plurality of compartments of the first type, and having a first locking latch designed to lock the entire first chamber, a second protective cover adapted to shield the plurality of compartments of the second type, and having a second locking latch designed to lock the entire second chamber, and circuitry configured to initiate a communication with the controlling device, receive instructions and the prescription schedule that is to be stored in the memory of the dispensing device, unlock the locking latch of at least one of the first cover and the second cover based on the received instructions, and trigger an alarm signal based on a delayed medication dosage.

2. The multi-functional homecare system according to claim 1, wherein the circuitry is configured to generate a message to be displayed on the display device based on a current date and time matching an entry included in the prescription schedule, and unlock at least one of the first cover and the second cover based on a type of medication associated with the current date and time.

3. The multi-functional homecare system according to claim 2, wherein the circuitry is further configured to generate an additional alert signal after a predetermined time-out period based on medication not being retrieved from the dispensing device after the triggering of the alarm signal.

4. The multi-functional homecare system according to claim 3, wherein the circuitry is further configured to detect via a detector, whether medication is removed from one of the first chamber and the second chamber within the predetermined time-out period.

5. The multi-functional homecare system according to claim 3, wherein the predetermined time-out period is received in the instructions transmitted from the controlling device.

6. The multi-functional homecare system according to claim 3, wherein the circuitry is further configured to transmit, via the network, a message to the controlling device, after the predetermined time-out period, to notify a medical care provider that a dosage of the medication corresponding to the current date and time has not been removed from the dispensing device.

7. The multi-functional homecare system according to claim 6, wherein the controlling device is configured to display the message transmitted by the dispensing device on a display panel of the controlling device.

8. The multi-functional homecare system according to claim 1, wherein the prescription schedule includes a dosage size of the medication, a time the medication is to be consumed, and the instructions include information regarding a method of taking the medication, drug interaction warnings for the medication, and potential side effect warnings for the medication.

9. The multi-functional homecare system according to claim 1, further comprising:

at least one health monitoring device that is configured to detect health and vital signals of a patient, and transmit the detected health and vital signals to the dispensing device, and wherein the circuitry of the dispensing device is further configured to transmit the received health and vital signals to the controlling device.

10. The multi-functional homecare system according to claim 1, wherein the second temperature range is one of 30° to 90° and 30° F. to 50° F.

* * * * *